US008493288B2

(12) United States Patent
Dickinson

(10) Patent No.: US 8,493,288 B2
(45) Date of Patent: Jul. 23, 2013

(54) SYSTEM AND METHOD FOR COLOR-SPECIFIC SEQUENCE SCALING FOR SEQUENTIAL COLOR SYSTEMS

(75) Inventor: Larry D. Dickinson, Richardson, TX (US)

(73) Assignee: Texas Instruments Incorporated, Dallas, TX (US)

( * ) Notice: Subject to any disclaimer, the term of this patent is extended or adjusted under 35 U.S.C. 154(b) by 994 days.

(21) Appl. No.: 11/545,436

(22) Filed: Oct. 10, 2006

(65) Prior Publication Data

US 2008/0084369 A1 Apr. 10, 2008

(51) Int. Cl.
*G09G 3/00* (2006.01)
*G09G 3/36* (2006.01)

(52) U.S. Cl.
USPC ..... 345/32; 345/88

(58) Field of Classification Search
USPC ..... 345/84, 72, 108, 32, 87–104, 204–215, 345/690–699; 359/45, 449, 249, 298, 290, 359/315, 318, 224; 348/743, 771, 756
See application file for complete search history.

(56) References Cited

U.S. PATENT DOCUMENTS

| | | | | |
|---|---|---|---|---|
| 4,566,935 | A | 1/1986 | Hornbeck | |
| 4,615,595 | A | 10/1986 | Hornbeck | |
| 4,662,746 | A | 5/1987 | Hornbeck | |
| 4,989,079 | A * | 1/1991 | Ito | 358/520 |
| 5,061,049 | A | 10/1991 | Hornbeck | |
| 5,083,857 | A | 1/1992 | Hornbeck | |
| 5,096,279 | A | 3/1992 | Hornbeck et al. | |
| 5,583,688 | A | 12/1996 | Hornbeck | |
| 5,706,061 | A | 1/1998 | Marshall et al. | |
| 5,912,712 | A * | 6/1999 | Doherty | 348/471 |
| 7,019,881 | B2 | 3/2006 | Doherty et al. | |
| 7,233,427 | B2 | 6/2007 | Doherty et al. | |
| 2003/0227677 | A1 * | 12/2003 | Doherty et al. | 359/449 |
| 2004/0213435 | A1 * | 10/2004 | Hatakeyama | 382/112 |
| 2006/0187519 | A1 * | 8/2006 | Doherty et al. | 359/245 |
| 2007/0064008 | A1 * | 3/2007 | Childers | 345/589 |
| 2007/0120786 | A1 * | 5/2007 | Bellls et al. | 345/84 |
| 2008/0143736 | A1 * | 6/2008 | Clatanoff et al. | 345/590 |

OTHER PUBLICATIONS

Ojima, H., et al. Isofrequency Band-Like Zones of Activation Revealed by Optical Imaging of Intrinsic Signals in the Cat Primary Auditory Cortex'. In Cerebral Cortex. Originally published online on Jan. 19, 2005, Cerebral Cortex 2005 15 (10), p. 1497-1509.

* cited by examiner

*Primary Examiner* — Alexander Eisen
*Assistant Examiner* — Patrick F Marinelli
(74) *Attorney, Agent, or Firm* — Warren L. Franz; Wade J. Brady, III; Frederick J. Telecky, Jr.

(57) ABSTRACT

System and method for adjusting the color segment durations for colors in a color sequence in sequential color display systems. A preferred embodiment comprises receiving a desired color sequence to display, computing a scaling factor for each color in the desired color sequence based on a reference color sequence, and sequentially displaying the colors in the desired color sequence. The reference color sequence used in computing the scaling factors specifies a duration for each color in the reference color sequence, while the desired color sequence specifies a desired duration for each color in the desired color sequence. The use of a single reference color sequence to create a large number of color sequences can save a significant amount of storage space and can allow for the storage of reference color sequences to meet varying chromatic properties due to changes in the display system, user settings, and operating environment.

16 Claims, 4 Drawing Sheets

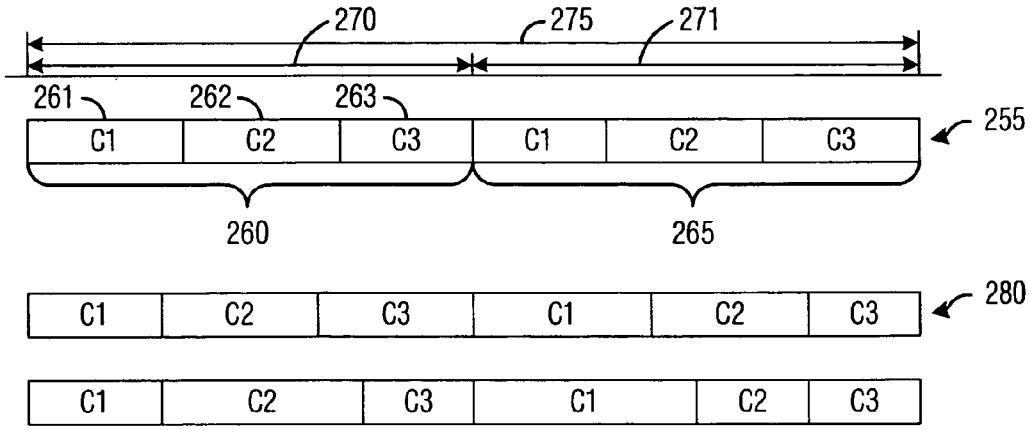
*Fig. 2b*
*(Prior Art)*
| | | | | | |
|---|---|---|---|---|---|
| C1 14 | C2 14 | C3 12 | C1 12 | C2 14 | C3 14 |
| C1 12 | C2 14 | C3 14 | C1 16 | C2 14 | C3 10 |
| C1 12 | C2 18 | C3 10 | C1 20 | C2 10 | C3 10 |
*Fig. 2c*
*(Prior Art)*
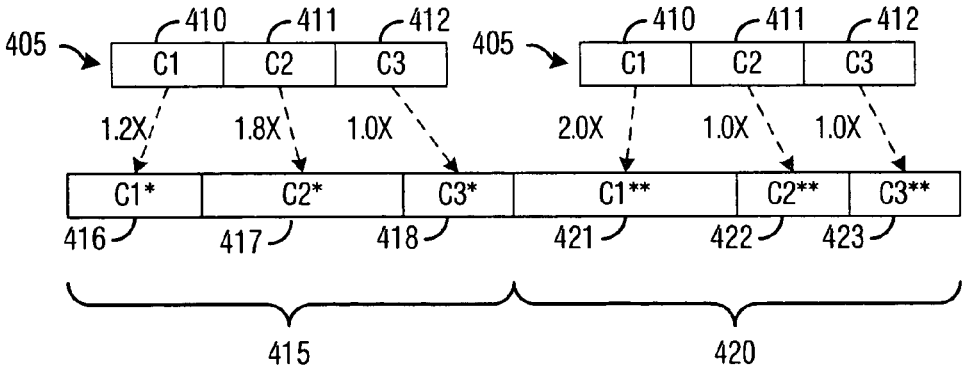
*Fig. 4*

SYSTEM AND METHOD FOR COLOR-SPECIFIC SEQUENCE SCALING FOR SEQUENTIAL COLOR SYSTEMS

TECHNICAL FIELD

The present invention relates generally to a system and method for image display systems, and more particularly to a system and method for adjusting the color segment durations for colors in a color sequence in sequential color display systems.

BACKGROUND

An example of a sequential color display system is a display system that utilizes a digital micromirror device (DMD) to produce images for display purposes. A DMD is a type of spatial light modulator that uses a large number of micromirrors arranged in an array. Each micromirror typically pivots about an axis and can reflect light from a light source either onto a display plane or away from the display plane, with the position (state) of the micromirrors in the DMD being dependent on the image being displayed. The image on the display plane is created by the micromirrors operating in conjunction with one another.

The DMD is normally a binary spatial light modulator, i.e., the light from the light source is either reflected onto or away from the display plane. To display shades of gray or color, it is necessary for the DMD-based display system to sequentially display colors and intensities of light (or simply, color sequences), with the states of the micromirrors in the DMD potentially changing along with the changing light. The human eye integrates the many images displayed by the display system over time, producing high-quality color images.

Until recently, most DMD-based display systems used high-intensity arc lamps to provide a broad spectrum light to illuminate a single DMD. This required the use of a rotating color wheel (a form of color filter that is capable of changing its color filtering characteristics over time) to generate sequences of colored light. It is then possible to create different colors and gray scales by varying the duration of time that the individual micromirrors reflect light onto the display plane. Since the color wheel is a physical entity, it is not possible to change the sequence of colors or their relative durations once the color wheel has been manufactured. It is possible, however, to change the duration of all of the individual color segments in the sequence of colors by altering the speed of the rotation, shortening all durations by increasing the rate of rotation or lengthening all durations by decreasing the rate of rotation.

More recent DMD-based display systems use rapidly switching light sources, such as light sources with solid-state light elements (for example, light-emitting diodes and laser diodes), to illuminate the DMD with light of different wavelengths. The rapidly switching light sources can enable the elimination of the color wheel, which can permit the display system to change the sequence of colors and/or the relative durations of the individual color segments as needed to produce desired colors and gray shades. A typical DMD-based display system will include descriptors for a wide variety of sequences of colors stored in memory. A detailed description of a DMD-based display system utilizing a solid-state light source is provided in a co-assigned U.S. Pat. No. 5,706,061, entitled "Spatial Light Image Display System with Synchronized and Modulated Light Source," issued Jan. 6, 1998, which U.S. patent is incorporated herein by reference.

With reference now to FIG. 1*a*, there is shown a diagram illustrating a high-level view of a portion of a prior art DMD-based display system 100. The display system 100 includes a DMD 105 that can be illuminated by a light source 110, which can be an electric arc lamp. Light produced by the light source 110 passes through a color wheel 115, which is rotated by a motor 117. The motor 117 can be controlled by a controller 120, which can also control the operation of the DMD 105 as well as the light source 110. A memory 125, coupled to the controller 120, can provide the image data for use in setting the states of the micromirrors in the DMD 105. Additionally, the memory 125 can store color sequence information, used to generate desired gray scales, shades of colors, and so forth.

With reference now to FIG. 1*b*, there is shown a diagram illustrating exemplary sequences of colors as generated by the display system 100. A first sequence of colors 155 includes two color cycles, with a first color cycle 160 including a duration of a first color "C1" 161, a duration of a second color "C2" 162, and a duration of a third color "C3" 163. A second color cycle 165 can also include the three colors C1, C2, and C3. Although shown as occurring in the same order as in the first color cycle 160, depending on the design of the color wheel 115, the ordering of the colors, the number of colors, or even the colors themselves in the second color cycle 165 may be different. The first color cycle 160 occurs within a first cycle time 170 and the second color cycle 165 occurs within a second cycle time 171. The combined duration of the first cycle time 170 and the second cycle time 171 can define a frame time 175, which can be the time allowed to display a single image (or a frame of an image, depending upon the nature of the display system). Again, depending on the design of a display system, a frame time can comprise a single color cycle time or multiple color cycle times.

Since the sequence of colors in the display system 100 is generated by the color wheel 115, the sequence of colors does not change over time. A second sequence of colors 180 is identical to the first sequence of colors 155. Although the sequence of colors can be identical, depending on the control of the micromirrors in the light modulator 105, the color sequences resulting from the sequence of colors can be significantly different. For example, in the first sequence of colors 155, all of traces of the color C1 can be eliminated from display on the display plane if the micromirrors in the light modulator 105 are transitioned to an off state while the color C1 is being produced, while in the second sequence of colors 180, some of the color C1 can be displayed on the display plane.

With reference now to FIG. 2*a*, there is shown a diagram illustrating a high-level view of a portion of a prior art DMD-based display system 200, wherein the display system 200 utilizes a rapidly switching light source 210 to illuminate a DMD 205. Rapidly switching light sources typically use solid-state light sources, such as LEDs or laser diodes, and can quickly switch on and off. The rapidly switching light source 210 can use multiple individual light elements (not shown) with the different light elements producing light at different wavelengths. This can enable the elimination of a color filter (the color wheel 115 (FIG. 1*a*)). A controller 220 can provide lighting control instructions to a light driver circuit 230, which can drive the rapidly switching light source 210. The controller 220 can also control the operation of the DMD 205. A memory 225, coupled to the controller 220, can provide the image data for use in setting the states of the micromirrors in the DMD 205. Additionally, the memory 225 can store color sequence information, used to generate desired gray scales, shades of colors, and so forth.

With reference now to FIG. 2*b*, there is shown a diagram illustrating exemplary sequences of colors as generated by the display system 200. A first sequence of colors 255 includes two color cycles, with a first color cycle 260 including a duration of a first color "C" 261, a duration of a second color "C2" 262, and a duration of a third color "C3" 263. A second color cycle 265 can also include the three colors C1, C2, and C3. Although shown as occurring in the same order as in the first color cycle 260, depending on the display system 200, the ordering of the colors, the number of colors, or even the colors themselves in the second color cycle 265 may be different. The first color cycle 260 occurs within a first cycle time 270 and the second color cycle 265 occurs within a second cycle time 271. The combined duration of the first cycle time 270 and the second cycle time 271 can define a frame time 275, which can be the time allowed to display a single image (or a frame of an image, depending upon the nature of the display system). Again, depending on the design of a display system, a frame time can comprise a single color cycle time or multiple color cycle times.

Since the sequence of colors in the display system 200 is generated by the controller 220, the sequence of colors can change over time. A second sequence of colors 280 can be different from the first sequence of colors 255, with the duration of the individual colors being different. This can be readily accomplished by controlling the rapidly switching light source 210 with color sequence information stored in the memory 225. A diagram shown in FIG. 2*c* illustrates specific color sequence descriptions of the sequences of colors shown in FIG. 2*b*, with each description of a color comprising a color name, for example "C1," "C2," "C3," and so forth, and a duration time (display duration), for example 14, 14, 12, and so on, units of time.

One disadvantage of the prior art is that although the use of rapidly switching light sources can enable changes in color sequences, it has been necessary to store the color sequence information in the memory of the display system. Given a potentially large number of color sequences, the memory storage requirements (and associated costs) can be significant. Additionally, the light output of solid state light sources can change over time and as they age, therefore, extra color sequences are needed to provide compensation for changes in light output. This can further increase the memory storage requirements.

SUMMARY OF THE INVENTION

These and other problems are generally solved or circumvented, and technical advantages are generally achieved, by preferred embodiments of the present invention which provide a system and a method for adjusting the color segment durations for colors in a color sequence in sequential color display systems.

In accordance with a preferred embodiment of the present invention, a method for displaying a color sequence is provided. The method includes receiving a desired color sequence to display, computing a scaling factor for each color in the desired color sequence based on a reference color sequence, and sequentially displaying each color in the desired color sequence based on the computed scaling factor for each respective color. The reference color sequence specifies a reference duration for each color in the reference color sequence, while the desired color sequence specifies a desired duration for each color in the desired color sequence.

In accordance with another preferred embodiment of the present invention, a method for displaying an image is provided. The method includes receiving a desired color sequence for use in illuminating a spatial light modulator, and computing a clock drop factor for each color in the desired color sequence, where a clock drop factor for each respective color is based on a reference duration for the respective color in a reference color sequence and a desired duration for the respective color in the desired color sequence. The method also includes sequentially displaying each color in the desired color sequence, and setting the state of each light modulator in the spatial light modulator using image data corresponding to the respective color being displayed. The duration of each color being displayed is controlled by applying the respective clock drop factor to the reference duration for the respective color in the reference color sequence.

In accordance with another preferred embodiment of the present invention, a display system is provided. The display system includes a light source, an array of light modulators that is optically coupled to the light source, and a memory for storing reference color sequences. Each reference color sequence contains data for generating light with specific chromatic properties under a set of display system conditions. The array of light modulators modulates light from the light source based upon image data to produce images on a display plane. The display system also includes a controller coupled to the array of light modulators, to the memory, and to the light source. The controller includes a sequence controller coupled to the array of light modulators that controls the modulation of the array of light modulators and specifies desired color sequences used to illuminate the array of light modulators, and a light controller coupled to the sequence controller, to the memory, and to the light source. The light controller issues commands to the light source to produce light corresponding to the color sequences from the sequence controller. The commands issued by the light controller are based on a selected reference color sequence that is selected based on a set of display system conditions or specified chromatic properties.

An advantage of a preferred embodiment of the present invention is that the storage requirements for the color sequences can be significantly reduced by storing a unique color sequence descriptor for each type of color sequence and generating all needed color sequences from the unique color sequence descriptor. This allows for the storage of a small number of color sequence descriptors rather than hundreds if not thousands of color sequences.

Another advantage of a preferred embodiment of the present invention is a more precise control of the color cycle times, which can yield images with actual chromatic characteristics that are closer to the intended chromatic characteristics.

A further advantage of a preferred embodiment of the present invention is that the hardware and software requirements for implementing the present invention are very small, which can reduce the costs associated with implementing the present invention in products.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiments disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which:

FIGS. 2*a* through 2*c* are diagrams of a high level view of a prior art DMD-based display system, exemplary sequences of colors, and exemplary descriptions of sequences of colors, wherein the display system utilizes a rapidly switching light source;

FIG. 4 is a diagram of sequences of colors generated from a reference color sequence, according to a preferred embodiment of the present invention;

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The present invention will be described with respect to preferred embodiments in a specific context, namely a sequential color display system utilizing a DMD (digital micromirror device) as a spatial light modulator. The invention may also be applied, however, to other sequential color display systems, such as those using deformable mirror, reflective liquid crystal, liquid crystal on silicon, and so forth, display technologies.

Figure 3:
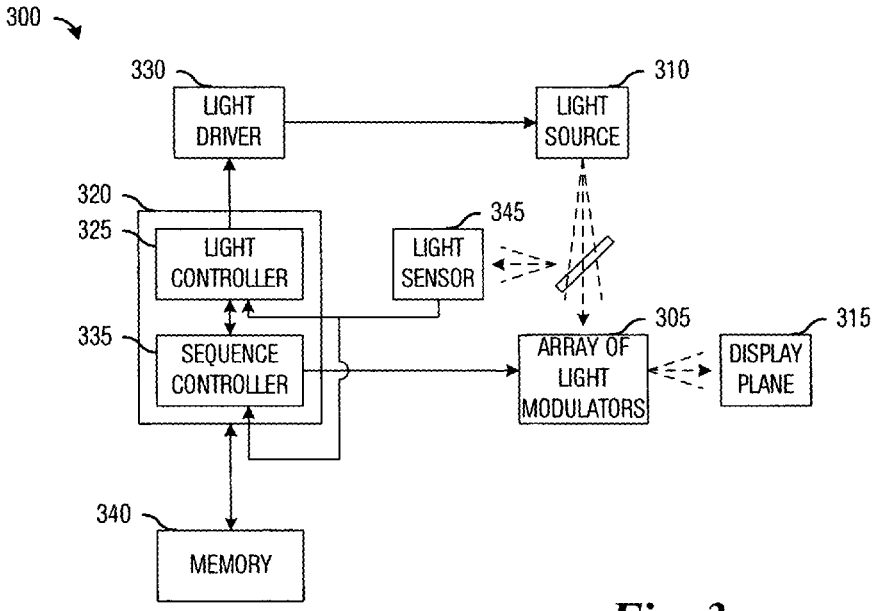
FIG. 3 is a diagram of a display system, according to a preferred embodiment of the present invention.

With reference now to FIG. 3, there is shown an exemplary display system 300, according to a preferred embodiment of the present invention. The display system utilizes an array of light modulators 305, wherein individual light modulators in the array of light modulators 305 assume a state corresponding to image data for an image being displayed by the display system 300. The array of light modulators 305 is preferably a digital micromirror device (DMD) with each light modulator being a positional micromirror. For example, in display systems where the light modulators in the array of light modulators 305 are micromirror light modulators, then light from a light source 310 can be reflected away or towards a display plane 315. A combination of the reflected light from all of the light modulators in the array of light modulators 305 produces an image corresponding to the image data. Although described in context with a DMD-based display system, the present invention can be utilized with other sequential color display systems, such as those using deformable mirror, reflective liquid crystal, liquid crystal on silicon, and so forth, display technologies.

A controller 320 can be responsible for the operation of the display system 300. The controller 320 can be a custom designed integrated circuit (also referred to as an application specific integrated circuit (ASIC)), a general purpose processor with customized software and firmware, a digital signal processor, and so forth. The controller 320 can contain circuitry such as a light controller circuit 325, which can be responsible for providing control signals to a light driver circuit 330. The control signals from the light controller circuit 325 can control a drive current to illuminate the light elements in the light source 310. Additionally, the light controller circuit 325 can also provide control signals and/or control instructions to turn on and off particular light elements in the light source 310 to produce light of desired color and intensity.

Also included in the controller 320 can be a sequence controller 335. The sequence controller 335 can be used to provide color sequences to the light controller 325. The color sequences provided by the sequence controller 335 can be based on image data that is to be loaded into the array of light modulators 305. For example, the bit weight of the image data (which specifies the significance of the image data) as well as the chromatic characteristics of the image data can have an effect on the color sequences provided to the light controller 325. According to a preferred embodiment of the present invention, the sequence controller 335 can provide a color sequence to the light controller 325, which can then compute clock drop factors for each color in a reference color sequence (which can be stored in a memory 340) based on the color sequence. Detailed descriptions of the clock dropping technique are provided in co-assigned U.S. Pat. No. 5,912,712, entitled "Time Expansion for Pulse Width Modulation Sequences by Clock Dropping," issued Jun. 15, 1999, and U.S. Pat. No. 7,019,881, entitled "Display System with Clock Dropping," issued Mar. 28, 2006, which U.S. patents are incorporated herein by reference.

The clock drop factors can either be stored back in the memory 340 for subsequent use or in dedicated memory (such as registers) located in the controller 320. Although shown in FIG. 3 as integrated into the controller 320, the light controller 325 and the sequence controller 335 can be separate units in the display system 300. While the light source 310 is producing light to illuminate the array of light modulators 305, image data corresponding to an image being displayed can be loaded into the array of light modulators 305 and used to set the state of the light modulators. The image data being loaded into the array of light modulators 305 corresponds to the color of light being produced by the light source 310. For example, when the light source 310 is producing a red light, then image data relevant to the red color is loaded into the array of light modulators 305.

A light sensor 345 can be used to detect the light produced by the light source 310. The light detected by the light source 310 can be converted into electrical signals by the light sensor 345 that can be provided to the light controller 325. The light controller 325 can make use of the electrical signals provided by the light sensor 345 to help ensure that the light being produced by the light source 310 matches the color sequence provided by the sequence controller 335. If the light does not match the color sequence provided by the sequence controller 335 within a specified margin, the light controller 325 can make adjustments to the control signals and commands that it is providing to the light driver 330 to make changes to the light being produced by the light source 310.

In addition to providing the electrical signals to the light controller 325, the light sensor 345 can also provide the electrical signals to the sequence controller 335. The electrical signals provided to the sequence controller 335 can provide information about the light output of the light source 310. The sequence controller 335 can then derive information about the capabilities of the light source 310. For example, the sequence controller 335 can compare the light output of the light source 310 with the light that it expects the light source 310 to produce. Using this information, the sequence controller 335 can make adjustments to the color sequences that it is providing the light controller 325. For example, if the sequence controller 335 determines that the color output of the light source 310 is changing, due to aging, for example, then the sequence controller 335 can instruct the light controller 325 to make use of a different reference color sequence to compensate for changes in the light source 310, or the sequence controller 335 can attempt to adjust the color sequences directly to compensate for changes in the light source 310.

Descriptions of the DMD, DMD fabrication, and DMD-based display systems can be found in greater detail in the following co-assigned U.S. patents: U.S. Pat. No. 4,566,935, issued Jan. 28, 1986, entitled "Spatial Light Modulator and Method," U.S. Pat. No. 4,615,595, issued Oct. 7, 1986, entitled "Frame Addressed Spatial Light Modulator," U.S. Pat. No. 4,662,746, issued May 5, 1987, entitled "Spatial Light Modulator and Method," U.S. Pat. No. 5,061,049, issued Oct. 29, 1991, entitled "Spatial Light Modulator and Method," U.S. Pat. No. 5,083,857, issued Jan. 28, 1992, entitled "Multi-Level Deformable Mirror Device," U.S. Pat. No. 5,096,279, issued Mar. 17, 1992, entitled "Spatial Light Modulator and Method," and U.S. Pat. No. 5,583,688, issued Dec. 10, 1996, entitled "Multi-Level Digital Micromirror Device," which patents are hereby incorporated herein by reference.

With reference now to FIG. 4, there is shown a diagram illustrating the use of a reference color sequence to generate color sequences, according to a preferred embodiment of the present invention. A reference color sequence can contain a description of a reference display time for each color in a color sequence. Typically, the reference display time specifies a minimum display time for each respective color in the color sequence. In addition to providing the reference display time for each color in the color sequence, the reference color sequence can contain information such as light source drive current, drive current waveform and duty cycle, which light elements to turn on or off, and so on.

The reference color sequence can be dependent on factors such as the chromatic characteristics of a light source, the usage history of the light source, the operating environment of the display system, and so forth. For example, a reference color sequence can describe the minimum display times for the colors in a color sequence that will produce a desired color temperature, given a specific light source, operating environment, and light source usage history. Different reference color sequences may be needed for producing different color temperatures, use with light sources, use in operating environments, different light source usage histories, and so forth. In an alternate preferred embodiment, the reference color sequence can describe a reference display time that specifies a nominal display time that is greater than the minimum display times for the colors in the color sequence. Then, utilizing scale factors between the minimum display time and the nominal display time, it is possible to effectively create color display times that are shorter in duration than the nominal times that are specified in the reference color sequence.

The diagram shown in FIG. 4 displays a reference color sequence 405 that includes descriptions of reference display times of a first color C1 410, a second color C2 411, and a third color C3 412. The reference display times for each color can be scaled, either up (the duration of a color lengthened) or down (the duration of a color shortened), to produce a desired display time for each color in a desired color sequence. The desired display time for a color in the desired color sequence can be a specified time value for the color, which, when viewed sequentially with other colors in the desired color sequence, can produce a light with a desired set of chromatic characteristics.

For example, the reference color sequence 405 can be used to produce a first color cycle 415, with the reference display time of the first color C1 410 being scaled by a factor of 1.2 times to produce a scaled first color C1* 416, the reference display time of the second color C2 411 being scaled by a factor of 1.8 times to produce a scaled second color C2* 417, and the reference display time of the third color C3 412 being scaled by a factor of 1.0 times to produce a scaled third color C3* 418. Similarly, the reference color sequence 405 can be used to produce a second color cycle 420, with the reference display time of the first color C1 410 being scaled by a factor of 2.0 times to produce a scaled first color C1 421, the reference display time of the second color C2 411 being scaled by a factor of 1.0 times to produce a scaled second color C2** 422, and the reference display time of the third color C3 412 being scaled by a factor of 1.0 times to produce a scaled third color C3** 423**.

Although the exemplary based color sequence descriptor 405 is a three-color color (RGB) sequence, the present invention can be applied to display systems utilizing other three-color sequences or more than three colors, i.e., multiprimary sequences. Additionally, the present invention can be applied to display systems using two colors. Therefore, the discussion of three-color color sequences should not be construed as being limiting to either the scope or the spirit of the present invention.

According to a preferred embodiment of the present invention, the scaling of the display times for each color provided by the reference color sequence 405 and the generation of the desired color sequence can have several constraints. For example, the desired color sequence should have an overall display time that is less than or equal to a color cycle period for the display system. Therefore, the display time of a red color, a blue color, and a green color should be less than or equal to the color cycle period. To simplify system design, the overall display time can further be restricted to being substantially equal to the color cycle period. Additionally, if the desired color sequence contains more than one color cycle, then the overall display time of the desired color sequence should be less than or equal to the frame time of the display system. Another potential constraint may be that the display times in the desired color sequence should be equal to or greater than the display times provided in the reference color sequence 305. This constraint may be relaxed by specifying nominal display time values in the reference color sequence 405 that are not the minimum display times for each color in the display system, which would permit the scaling of a color's display time to a value that is smaller than the specified display time in the reference color sequence 405.

Figure 1A:
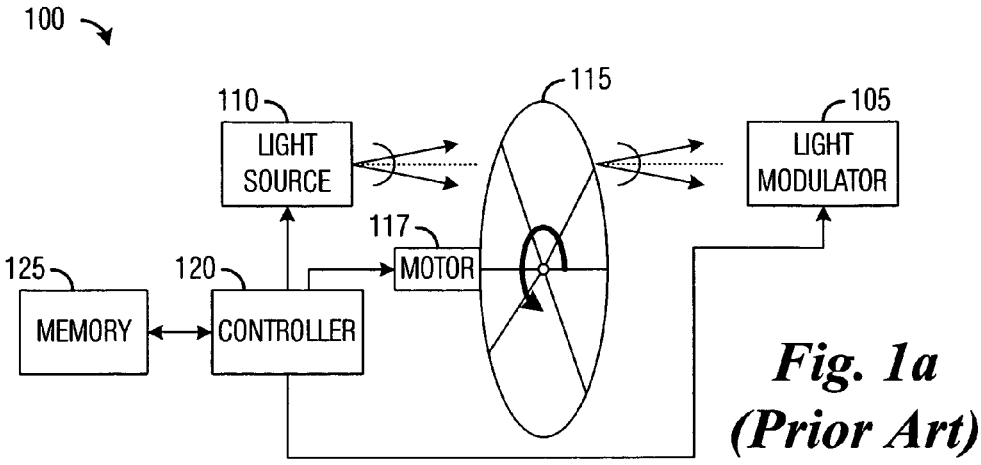
Fig. 1a (Prior Art)
FIGS. 1*a* and 1*b* are diagrams of a high level view of a prior art DMD-based display system and exemplary sequences of colors.
Figure 1B:
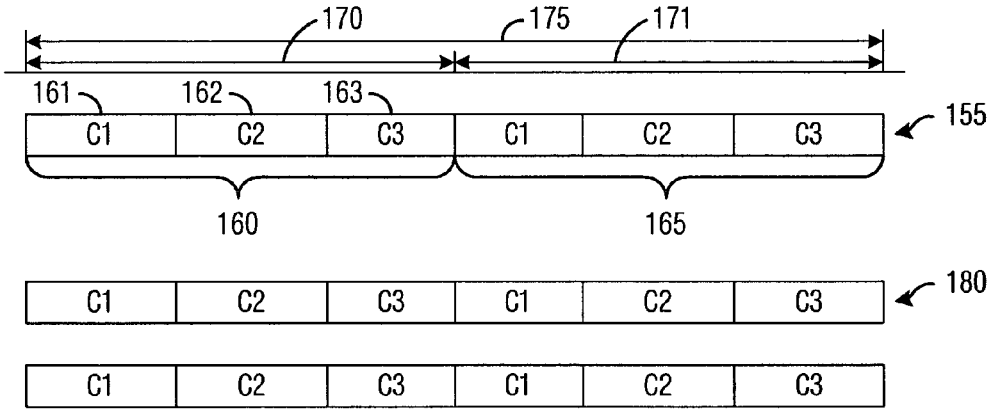
Fig. 1b (Prior Art)
Figure 2A:
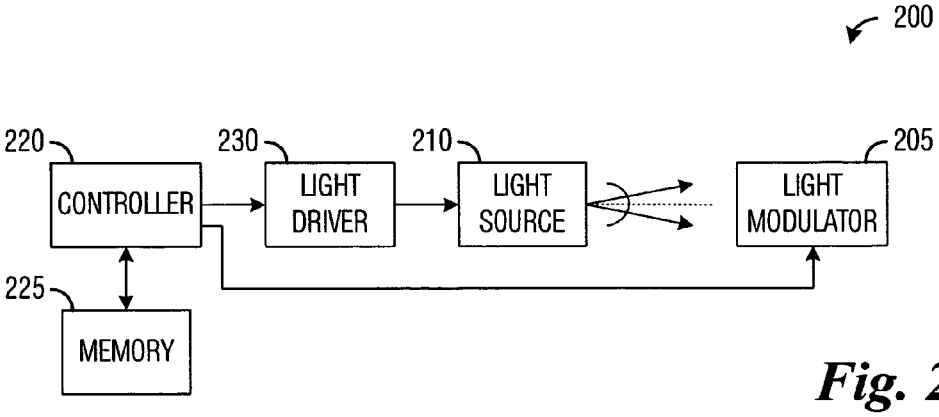
Fig. 2a (Prior Art)
Figure 5A:
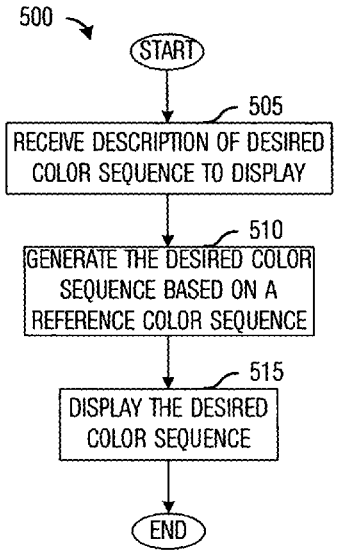
FIGS. 5*a* and 5*b* illustrate sequences of events in the displaying of a desired color sequence and a detailed view of an exemplary use of a reference color sequence to generate the desired color sequence, according to a preferred embodiment of the present invention.
Figure 5B:
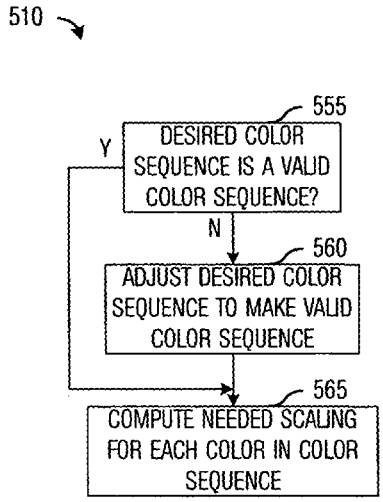

With reference now to FIGS. 5*a* and 5*b*, there are diagrams illustrating sequences of events in the displaying of a desired color sequence (sequence of events 500 (FIG. 5*a*)) and a detailed view of an exemplary use of a reference color sequence to generate the desired color sequence (FIG. 5*b*), according to a preferred embodiment of the present invention. The sequence of events 500, shown in FIG. 5*a*, illustrates the events involved in the projection of a desired color sequence by a display device. The projection of the desired color sequence can begin with the reception of a description of the desired color sequence at a light controller circuit from a sequence controller (block 505). The description of the desired color sequence can include information such as a duration for each color in the desired color sequence.

According to a preferred embodiment of the present invention, the desired color sequence can be based upon factors such as the bit-weight of the image data being displayed, the relative distribution of colors in the image being displayed, the colors previously displayed, the colors to be displayed, the nature of the source of the images and the image data, and so forth. The sequence controller can, based on these factors, provide color sequences to the light controller circuit to have the light source produce colors of the color sequences and illuminate the array of light modulators.

The light controller circuit can then generate the control information necessary to generate the desired color sequence using the reference color sequence (block 510). The control information generated by the light controller circuit, when provided to the light source, will result in the light source producing the desired color sequence. A detailed description of the generation of the control information necessary to generate the desired color sequence is provided below. Alternatively, the light controller circuit can directly produce the drive signals for the light source needed to produce the desired color sequence from the reference color sequence. Finally, using the control information produced by the light controller circuit, the light source can display the desired color sequence (block 515).

The sequence of events shown in FIG. 5*b* can be a detailed description of the generation of the desired color sequence based on the reference color sequence 510. Prior to generating the control information used to generate the desired color sequence, a check on the validity of the desired color sequence can be made (block 555). Under the constraints of the reference color sequence, the desired color sequence as provided by the sequence controller may be invalid. For example, the desired color sequence may violate a constraint that requires a certain proportion of each color be present in the color sequence. The desired color sequence may also violate a constraint that a sum of the display times for all of the colors be substantially equal to the color cycle time (color cycle time duration). If the desired color sequence is not a valid color sequence based on the reference color sequence, an adjustment (or adjustments) can be made to the desired color sequence to make the desired color sequence a valid color sequence (block 560). For example, the display times of the colors may need to be adjusted so that their sum will be substantially equal to the color cycle time, the proportions of the colors within the desired color sequence can be adjusted so that the proportions will meet the specified proportions in the reference color sequence, and so forth.

Once the desired color sequence has been adjusted or if the desired color sequence as provided by the sequence controller is a valid color sequence, then a scaling factor can be computed for each color in the desired color sequence (block 565). The scaling factor can be computed based on the display time for each color as specified in the reference color sequence. For example, if the display time specified for a color in the reference color sequence is ten (10) milliseconds and a desired display time for the color is 14 milliseconds, then the scaling factor can be 1.4. The computed scaling factor for each color in the desired color sequence can be stored in a memory and then used sequentially to produce drive signals for driving the light source. For example, if the scaling factors for a RGB display system are RSF, GSF, and BSF, then each of the three scaling factors can be used by the light controller circuit to produce drive signals for use in having the light source produce the desired red, green, and blue colors in the desired order with the desired chromatic characteristics.

According to a preferred embodiment of the present invention, a desired display time for a color can be generated from a specified display time for the color in the reference color sequence by using a technique referred to as clock dropping. In clock dropping, a pulse width modulated sequence of a particular duration may be expanded by utilizing a cycle drop counter that counts cycles of a reference clock and causes a drop of a cycle of the reference clock whenever the counter resets or reaches a specified value. It is also possible to drop more than one cycle of the reference clock whenever the counter resets or reaches a specified value. The dropping of the clock cycles causes the pulse width modulated sequence duration to be expanded. The more clock cycles dropped, the greater the expansion of the pulse width modulated sequence. Detailed descriptions of the clock dropping technique are provided in co-assigned U.S. Pat. No. 5,912,712, entitled "Time Expansion for Pulse Width Modulation Sequences by Clock Dropping," issued Jun. 15, 1999, and U.S. Pat. No. 7,019,881, entitled "Display System with Clock Dropping," issued Mar. 28, 2006.

In a situation when a desired display time for a color is shorter than a reference display time for the color in the reference color sequence, it can be possible to scale the reference display time down to be substantially equal to the desired display time. This can occur when the reference display time for the color in the reference color sequence is a nominal display time and not the minimum display time for the color, since the minimum display time for a color is the shortest display time duration for the color in a display system. In order to shorten the display time when the minimum display time is specified, techniques other than simply modifying the display time must be employed to effectively reduce the amount of light produced by the display system, such as the use of neutral density filters, changing a diameter of an aperture positioned between the light source and the array of light modulators, and so forth. The nominal display time for a color can be longer in duration than the minimum display time, enabling the generation of a wide range of display times.

For example, if a nominal display time for each color in a three-color color sequence is specified as 50 time units, a minimum display time for the color is 30 time units, and a color cycle time is 150 time units, it can be possible to generate display times for a single color in the color sequence ranging from a minimum of about 30 time units to a maximum of about 90 time units, with the remaining 60 time units of the color cycle time being reserved to display the two remaining colors in the color sequence.

When clock dropping is used, the scaling factors for each color in the desired color sequence, calculated in block 565, can be referred to as clock drop factors, specifying the value in the cycle drop counter. The clock drop factor for each color in the desired color sequence can be stored in a memory after calculation and then recalled when the time to generate the particular color arises.

Figure 6A:
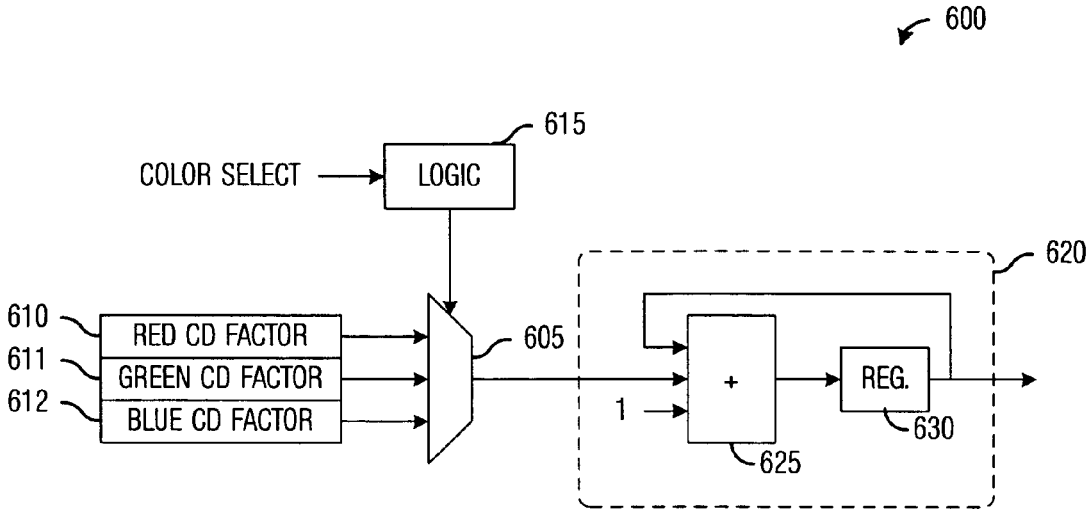
FIGS. 6*a* and 6*b* are diagrams of exemplary timer enable circuits, according to a preferred embodiment of the present invention.
Figure 6B:
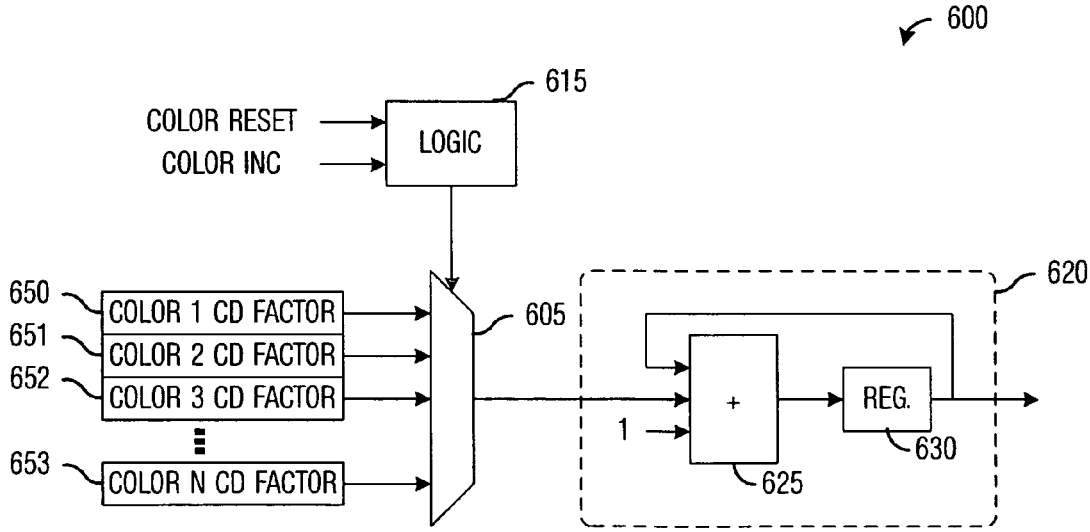

With reference now to FIGS. 6*a* and 6*b*, there are shown diagrams illustrating a timer enable circuit 600 that is used in a light controller for controlling the duration of colors in a color sequence, according to a preferred embodiment of the present invention. The timer enable circuit 600 shown in FIG. 6*a* can be used in a display system that utilizes primary colors (red, green, and blue). The timer enable circuit 600 includes a multiplexer 605. The multiplexer 605 can have as inputs, clock drop factors (such as a red clock drop factor 610, a green clock drop factor 611, and a blue clock drop factor 612) for each of the three colors in the color sequence. The selections of which input to the multiplexer 605 to provide at its output can be performed by a logic block 615. The logic block 615 can have as input a color select signal from a sequence controller of the display system. According to a preferred embodiment of the present invention, the color select signal can be a three-bit value with an active bit representing the color to be produced by the light source. For example, if the color select signal has a value <0:1:0> where <red:green: blue> is the ordering of the bit representations, then the sequence controller has selected the green color to be produced by the light source. The logic block 615 performs any necessary conversions to make the three-bit value into a form that is compatible with the multiplexer 605.

The output of the multiplexer 605 (a clock drop value for the selected color) can be provided to a clock drop circuit 620. The clock drop circuit 620 can include an adder 625 and a register 630. The register 630, preferably implemented using D-type flip-flops, can store the current value of the clock drop count. The adder 625 can adjust the value stored in the register 630 by a specified value, preferably the selected clock drop factor plus one. The combination of the register 630 and the adder 625 can be used as the clock drop counter discussed previously. An overflow bit of the register 630 can be an output of the clock drop circuit 620 and can be used as a timer enable. As another example, the diagram shown in FIG. 6*b* illustrates an embodiment of the timer enable circuit 600 for a multiprimary display system with N colors and with clock drop factors: color 1 CD factor 650, color 2 CD factor 651, color 3 CD factor 652, up through color N CD factor 653. A detailed description of a clock dropping circuit can be found in co-assigned U.S. Pat. No. 5,912,712, entitled "Time Expansion for Pulse Width Modulation Sequences by Clock Dropping," issued Jun. 15, 1999, and U.S. Pat. No. 7,019,881, entitled "Display System with Clock Dropping," issued Mar. 28, 2006.

Although the present invention and its advantages have been described in detail, it should be understood that various changes, substitutions and alterations can be made herein without departing from the spirit and scope of the invention as defined by the appended claims.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method for displaying a color sequence, using color-specific sequence scaling to compensate for variations in light output of different color light sources, comprising:

providing a reference color sequence for display of an image using light from the respective different color light sources, wherein the reference color sequence specifies a reference duration for each color in the reference color sequence for a reference light output of each corresponding color light source, and wherein the reference color sequence is determined based on bit weight and chromatic characteristics information, and information derived from received image data;

computing a color-specific scaling factor for each color in the reference color sequence for an actual light output of the corresponding color light source; and controlling the operation of the color light sources to sequentially display each color in the color sequence based on the reference color sequence scaled by the computed scaling factor for each respective color.

2. The method of claim 1, wherein the reference color sequence is provided by retrieving a prestored color sequence from memory.

3. The method of claim 2, further comprising sensing the light output of the different light sources, and determining the actual light output from the sensed light output.

4. The method of claim 3, wherein the reference duration for each color is a display time greater or equal to a minimum display time, and the color-specific scaling factor is a factor that does not reduce a display time to less than the minimum display time.

5. The method of claim 4, wherein each color is displayed by sequentially illuminating a spatial light modulator having an array of light modulators, individual modulators of which assume states in synchronism with the different color illuminations based on settings derived from the image data.

6. The method of claim 5, wherein the spatial light modulator is a digital micromirror device, and the modulators are micromirrors.

7. The method of claim 6, wherein the color-specific scaling factor is a clock drop factor, and the reference color sequence is scaled using clock dropping.

8. The method of claim 7, further comprising storing the computed color-specific scaling factor in a memory.

9. The method of claim 1, wherein the reference duration for each color is a minimum display time, and the color-specific scaling factor is a factor greater than or equal to one.

10. The method of claim 1, wherein the reference duration for each color is a nominal display time greater than a minimum display time, and the color-specific scaling factor is a factor greater or less than one, that does not reduce a display time to less than the minimum display time.

11. The method of claim 1, wherein the reference color sequence is provided by retrieving a prestored color sequence from a memory.

12. The method of claim 1, further comprising sensing the light output of the different light sources, and determining the actual light output from the sensed light output.

13. The method of claim 1, further comprising storing the computed color-specific scaling factor in a memory.

14. The method of claim 1, wherein the color-specific scaling factor is a clock drop factor, and the reference color sequence is scaled using includes clock dropping.

15. The method of claim 1, wherein each color is displayed by sequentially illuminating a spatial light modulator having an array of light modulators, individual modulators of which assume states in synchronism with the different color illuminations based on settings derived from the image data.

16. The method of claim 15, wherein the spatial light modulator is a digital micromirror device, and the modulators are micromirrors.

* * * * *